US010424243B2

(12) United States Patent
Kim et al.

(10) Patent No.: US 10,424,243 B2
(45) Date of Patent: Sep. 24, 2019

(54) ORGANIC LIGHT EMITTING DIODE DISPLAY

(71) Applicant: LG Display Co., Ltd., Seoul (KR)

(72) Inventors: Daekyu Kim, Seoul (KR); Heekwang Kang, Gyeonggi-do (KR); Chunghoon Lee, Gyeonggi-do (KR); Yongjoon Jung, Seoul (KR)

(73) Assignee: LG Display Co., Ltd., Seoul (KR)

( * ) Notice: Subject to any disclaimer, the term of this patent is extended or adjusted under 35 U.S.C. 154(b) by 247 days.

(21) Appl. No.: 15/364,720

(22) Filed: Nov. 30, 2016

(65) Prior Publication Data

US 2017/0154572 A1 Jun. 1, 2017

(30) Foreign Application Priority Data

Dec. 1, 2015 (KR) ..... 10-2015-0169907

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC combination set(s) only.
See application file for complete search history.

(56) References Cited

U.S. PATENT DOCUMENTS

2011/0157135 A1* 6/2011 Lee ..... G09G 3/3291 345/211
2012/0105496 A1* 5/2012 Komiya ..... G09G 3/003 345/690

(Continued)

FOREIGN PATENT DOCUMENTS

EP 1 653 434 A1 5/2006
EP 1965370 A2 9/2008
KR 10-2015-0069773 A 6/2015

OTHER PUBLICATIONS

Partial European Search Report dated Mar. 13, 2017, issued in corresponding European Patent Application No. 16201677.8.

(Continued)

*Primary Examiner* — Robin J Mishler
(74) *Attorney, Agent, or Firm* — Morgan, Lewis & Bockius LLP

(57) ABSTRACT

An organic light emitting diode display is discussed. The organic light emitting diode display includes a display area, in which first scan lines, second scan lines, and emission lines are disposed to intersect data lines, and pixels are disposed in a matrix, a data driver supplying a data voltage to the data lines, and a shift register supplying a first scan signal to the first scan lines, supplying a second scan signal to the second scan lines, and supplying an emission control signal to the emission lines. The shift register includes first scan signal stages sequentially supplying the first scan signal to pixels arranged on two adjacent horizontal lines, second scan signal stages sequentially supplying the second scan signal to the pixels, and an emission control signal stage simultaneously supplying the emission control signal to the pixels.

14 Claims, 10 Drawing Sheets

(52) U.S. Cl.
CPC ..... *G09G 2300/0439* (2013.01); *G09G 2300/0842* (2013.01); *G09G 2300/0861* (2013.01); *G09G 2310/0216* (2013.01); *G09G 2310/0262* (2013.01); *G09G 2310/0286* (2013.01); *G09G 2310/0289* (2013.01); *G09G 2310/0297* (2013.01); *G09G 2310/08* (2013.01)

(56) References Cited

U.S. PATENT DOCUMENTS

| | | | | |
|---|---|---|---|---|
| 2013/0314308 | A1 | 11/2013 | Hsu et al. | |
| 2014/0333513 | A1* | 11/2014 | Park ..... | G09G 3/3266 345/76 |
| 2015/0109018 | A1 | 4/2015 | Ma et al. | |

OTHER PUBLICATIONS

Extended European Search Report dated Jul. 10, 2017, for corresponding European Patent Application No. 16201677.8.

* cited by examiner

ORGANIC LIGHT EMITTING DIODE DISPLAY

This application claims the benefit of Korea Patent Application No. 10-2015-0169907 filed on Dec. 1, 2015, the entire contents of which is incorporated herein by reference for all purposes as if fully set forth herein.

BACKGROUND OF THE INVENTION

Field of the Invention

The present disclosure relates to an organic light emitting diode display.

Discussion of the Related Art

An active matrix organic light emitting diode (OLED) display includes organic light emitting diodes (OLEDs) capable of emitting light by themselves (i.e., self-emitting), and has advantages of a fast response time, a high emission efficiency, a high luminance, and a wide viewing angle. The OLED display arranges pixels each including an OLED in a matrix and adjusts a luminance of the pixels based on a gray scale of video data. Each pixel includes a driving thin film transistor (TFT) controlling a driving current flowing in the OLED based on a gate-to-source voltage of the driving TFT, a storage capacitor for uniformly holding the gate-to-source voltage of the driving TFT during one frame, and at least one scan TFT programming the gate-to-source voltage of the driving TFT in response to a gate signal. The driving current flowing in the OLED is determined by the gate-to-source voltage of the driving TFT controlled based on a data voltage. The luminance of the pixel is proportional to a magnitude of the driving current flowing in the OLED.

In general, the OLED display applies the data voltage to a gate electrode of the driving TFT using the scan TFT, that is turned on in response to a scan signal, and causes the OLED to emit light using the data voltage supplied to the driving TFT. The OLED display turns on the driving TFT and an input terminal of a high potential voltage using an emission control signal.

Driving circuits generating the scan signal and the emission control signal may be implemented in a gate-in-panel (GIP) type in a bezel area of a display panel. Because the OLED display requires a large number of scan signals, a GIP circuit becomes complicated and large in size by the number of scan signals. An increase in the size of the GIP circuit leads to an increase in the size of the bezel area (i.e., a non-display area of the display panel).

SUMMARY

Accordingly, the present invention is directed to an organic light emitting diode display that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light emitting diode display comprises a display area, in which first scan lines, second scan lines, and emission lines are disposed to intersect data lines, and pixels are disposed in a matrix, a data driver configured to supply a data voltage to the data lines, and a shift register configured to supply a first scan signal to the first scan lines, supply a second scan signal to the second scan lines, and supply an emission control signal to the emission lines, wherein the shift register includes a pair of first scan signal stages configured to sequentially supply the first scan signal to pixels arranged on two adjacent horizontal lines, a pair of second scan signal stages configured to sequentially supply the second scan signal to the pixels arranged on the two adjacent horizontal lines, and an emission control signal stage configured to simultaneously supply the emission control signal to the pixels arranged on the two adjacent horizontal lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
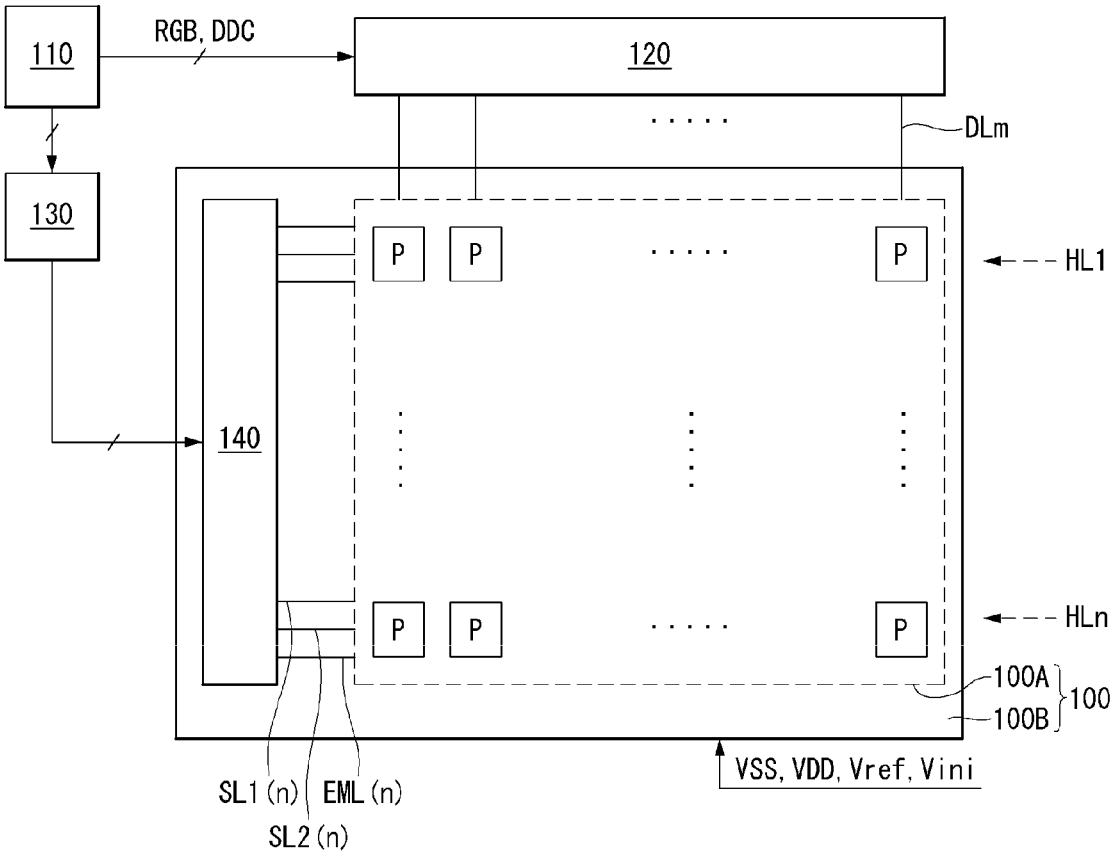
FIG. 1 illustrates an organic light emitting diode (OLED) display according to an example embodiment.

Reference will now be made in detail to embodiments of the present disclosure, examples of which are illustrated in the accompanying drawings. In the following description, when a detailed description of well-known functions or configurations related to this document is determined to unnecessarily cloud a gist of the invention, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a certain order. Like reference numerals designate like elements throughout.

Figure 2:
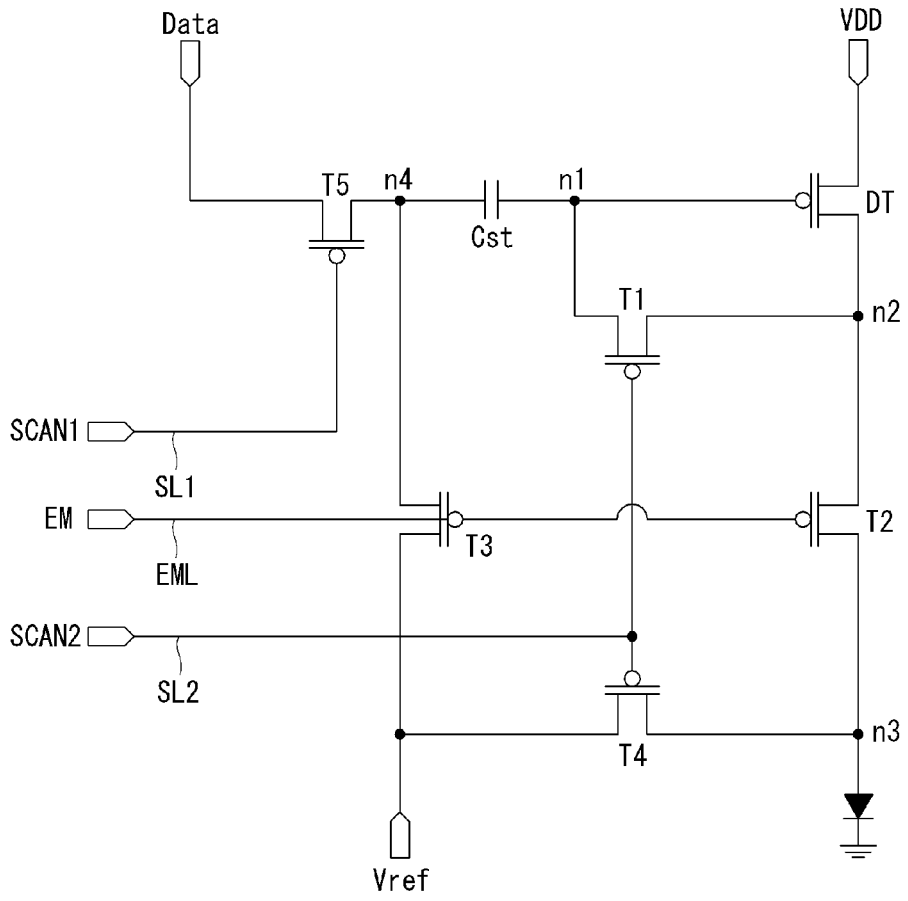
FIG. 2 illustrates a structure of a pixel according to an example embodiment.

FIG. 1 illustrates an organic light emitting diode (OLED) display according to an example embodiment. FIG. 2 illustrates a structure of a pixel according to an example embodiment.

Referring to FIGS. 1 and 2, an OLED display according to an example embodiment includes a display panel 100 on which pixels P are arranged in a matrix, a data driver 120 for driving data lines DL of the display panel 100, gate drivers 130 and 140 for driving gate lines GL of the display panel 100, and a timing controller 110 for controlling driving timings of the data driver 120 and the gate drivers 130 and 140.

The display panel 100 includes a display portion 100A, in which the pixels P are disposed and on which an image is displayed, and a non-display portion 100B, in which the gate driver 140 is disposed and on which an image is not displayed.

The display portion 100A includes the plurality of pixels P and displays an image based on a gray level represented by each pixel P. The pixels P are arranged along first to nth horizontal lines HL1 to HLn, where n is a natural number.

Each pixel P is connected to the data line DL and an initialization line arranged in parallel with the data line DL. Further, each pixel P is connected to a first scan line SL1, a second scan line SL2, and an emission control signal line EML, that are arranged in parallel with the horizontal line HL. Each pixel P includes an organic light emitting diode (OLED), a driving transistor DT, first to fifth transistors T1 to T5 and a storage capacitor Cst. The transistors DT, T1 to T5 may be implemented as a polycrystalline thin film transistor (TFT) including a polycrystalline semiconductor layer. However, example embodiments are not limited thereto. For example, a semiconductor layer of the thin film transistor may be made of amorphous silicon or oxide semiconductor.

The timing controller 110 rearranges digital video data RGB received from the outside in conformity with a resolution of the display panel 100 and supplies the rearranged digital video data RGB to the data driver 120. The timing controller 110 generates a data control signal DDC for controlling operation timing of the data driver 120 and a gate control signal GDC for controlling operation timing of the gate drivers 130 and 140 based on timing signals, such as a vertical sync signal Vsync, a horizontal sync signal Hsync, a dot clock DCLK, and a data enable signal DE.

The data driver 120 converts the digital video data RGB received from the timing controller 110 into an analog data voltage based on the data control signal DDC.

The gate drivers 130 and 140 sequentially supply a gate pulse to the gate lines GL under the control of the timing controller 110. The gate pulse output from the gate drivers 130 and 140 is synchronized with the data voltage. The gate drivers 130 and 140 include a level shifter 130 and a shift register 140, that are connected between the timing controller 110 and the scan lines of the display panel 100. The level shifter 130 level-shifts a transistor-transistor logic (TTL) level voltage of clocks received from the timing controller 110 to a gate high voltage VGH and a gate low voltage VGL.

FIG. 2 illustrates a structure of a pixel according to an example embodiment.

With reference to FIG. 2, a structure of a pixel P according to an example embodiment is described below.

Each pixel P includes an organic light emitting diode (OLED), a driving transistor DT, first to fifth transistors T1 to T5, and a storage capacitor Cst. In one embodiment, all of transistors are implemented as p-type transistors. In other embodiments, other configurations may be used. For example, transistors may be implemented as n-type transistors.

The OLED emits light using a driving current Ioled supplied from the driving transistor DT. The OLED includes an anode electrode, a cathode electrode, and a multi-layered organic compound layer between the anode electrode and the cathode electrode. The multi-layered organic compound layer includes a hole injection layer HIL, a hole transport layer HTL, an emission layer EML, an electron transport layer ETL, and an electron injection layer EIL. The anode electrode of the OLED is connected to a third node n3, and the cathode electrode of the OLED is connected to an input terminal of a low potential voltage VSS.

The driving transistor DT controls the driving current Ioled applied to the OLED depending on a gate-to-source voltage Vgs of the driving transistor DT. A gate electrode of the driving transistor DT is connected to a first node n1, a source electrode of the driving transistor DT is connected to a second node n2, and a drain electrode of the driving transistor DT is connected to an input terminal of a high potential voltage VDD.

First and second electrodes of the first transistor T1 are respectively connected to the first node n1 and the second node n2, and a gate electrode of the first transistor T1 is connected to the second scan line SL2. Namely, the first transistor T1 is turned on in response to a second scan signal SCAN2 and connects the first node n1 and the second node n2.

First and second electrodes of the second transistor T2 are respectively connected to the second node n2 and the third node n3, and a gate electrode of the second transistor T2 is connected to the emission line EML. Namely, the second transistor T2 turns on a current path between the driving transistor DT and the OLED in response to an emission control signal EM.

First and second electrodes of the third transistor T3 are respectively connected to a fourth node n4 and an input terminal of a reference voltage Vref, and a gate electrode of the third transistor T3 is connected to the emission line EML. Namely, the third transistor T3 supplies the reference voltage Vref to the fourth node n4 in response to the emission control signal EM.

First and second electrodes of the fourth transistor T4 are respectively connected to the third node n3 and the input terminal of the reference voltage Vref, and a gate electrode of the fourth transistor T4 is connected to the second scan line SL2. Namely, the fourth transistor T4 supplies the reference voltage Vref to the third node n3 in response to a scan signal SCAN.

First and second electrodes of the fifth transistor T5 are respectively connected to the data line DL and the fourth node n4, and a gate electrode of the fifth transistor T5 is connected to the first scan line SL1. Namely, the fifth transistor T5 supplies a data voltage Vdata to the fourth node n4 in response to the scan signal SCAN.

The storage capacitor Cst is connected between the first node n1 and the fourth node n4. The storage capacitor Cst is used to sample a threshold voltage of the driving transistor DT in accordance with a source-follower manner.

Figure 3:
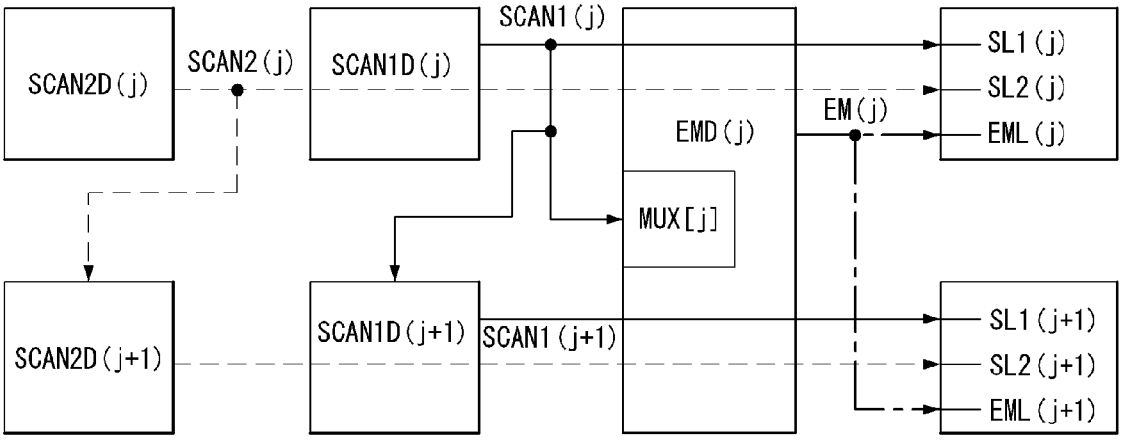
FIG. 3 illustrates a configuration of a shift register according to a first example embodiment.

FIG. 3 illustrates a configuration of a shift register according to an example embodiment. In the following description, "forward stage" is a stage positioned ahead of a reference stage. For example, when an ith stage STGi of a first shift register 140-1 is determined as a reference stage, the forward stage is one of first to (i−1)th stages ST1 to STG(i−1), where "i" is a natural number less than n. Further, "backward stage" is a stage positioned behind the reference stage. For example, when the ith stage STGi of the first shift register 140-1 is determined as the reference stage, the backward stage is one of (i+1)th to nth stages STG(i+1) to STGn.

FIG. 3 illustrates stages connected to pixels arranged on a jth horizontal line and a (j+1)th horizontal line, where "j" is a natural number less than n.

Referring to FIG. 3, stages for driving pixels arranged on a pair of adjacent horizontal lines HLj and HL(j+1) include a first scan signal stage SCAN1D(j) of the jth horizontal line HLj, a second scan signal stage SCAN2D(j) of the jth horizontal line HLj, a first scan signal stage SCAN1D(j+1) of the (j+1)th horizontal line HL(j+1), a second scan signal stage SCAN2D(j+1) of the (j+1)th horizontal line HL(j+1), and an emission control signal stage EMD(j) of the jth horizontal line HLj.

The jth first scan signal stage SCAN1D(j) generates a first scan signal SCAN1(j) of the jth horizontal line HLj and applies the jth first scan signal SCAN1(j) to a first scan line SL1(j) of the jth horizontal line HLj.

The jth second scan signal stage SCAN2D(j) generates a second scan signal SCAN2(j) of the jth horizontal line HLj and applies the jth second scan signal SCAN2(j) to a second scan line SL2(j) of the jth horizontal line HLj.

The (j+1)th first scan signal stage SCAN1D(j+1) generates a first scan signal SCAN1(j+1) of the (j+1)th horizontal line HL(j+1) and applies the (j+1)th first scan signal SCAN1(j+1) to a first scan line SL1(j+1) of the (j+1)th horizontal line HL(j+1). The (j+1)th first scan signal stage SCAN1D(j+1) receives the jth first scan signal SCAN1(j) as a start signal and operates.

The (j+1)th second scan signal stage SCAN2D(j+1) generates a second scan signal SCAN2(j+1) of the (j+1)th horizontal line HL(j+1) and applies the (j+1)th second scan signal SCAN2(j+1) to a second scan line SL2(j+1) of the (j+1)th horizontal line HL(j+1). The (j+1)th second scan signal stage SCAN2D(j+1) receives the jth second scan signal SCAN2(j) as a start signal and operates.

The jth emission control signal stage EMD(j) generates an emission control signal EM(j) of the jth horizontal line and applies the jth emission control signal EM(j) to emission control signal lines EML(j) of the jth horizontal line HLj connected to pixels Pj of the jth horizontal line and emission control signal lines EML(j+1) of the (j+1)th horizontal line HLj connected to pixels P(j+1) of the (j+1)th horizontal line HL(j+1).

Because pixels arranged on a pair of adjacent horizontal lines are driven in response to the same emission control signal, pixels arranged on n horizontal lines can be driven using n/2 emission control signal stages. In other words, because the example embodiment can reduce a total area of the shift register 140 through a reduction in the number of emission control signal stages, the example embodiment can reduce the size of a bezel area of the non-display portion 100B.

An emission control signal stage for controlling pixels arranged on two horizontal lines is described below.

Figure 4:
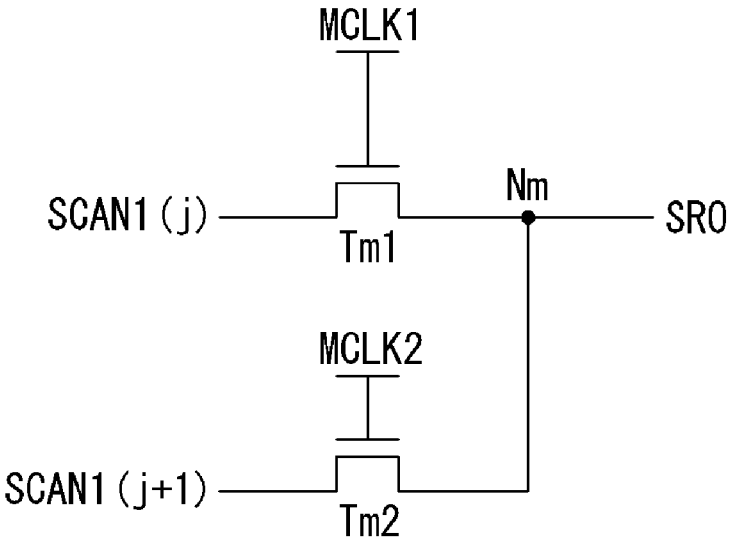
FIG. 4 illustrates a multiplexer of an emission control signal stage shown in FIG. 3.
Figure 5:
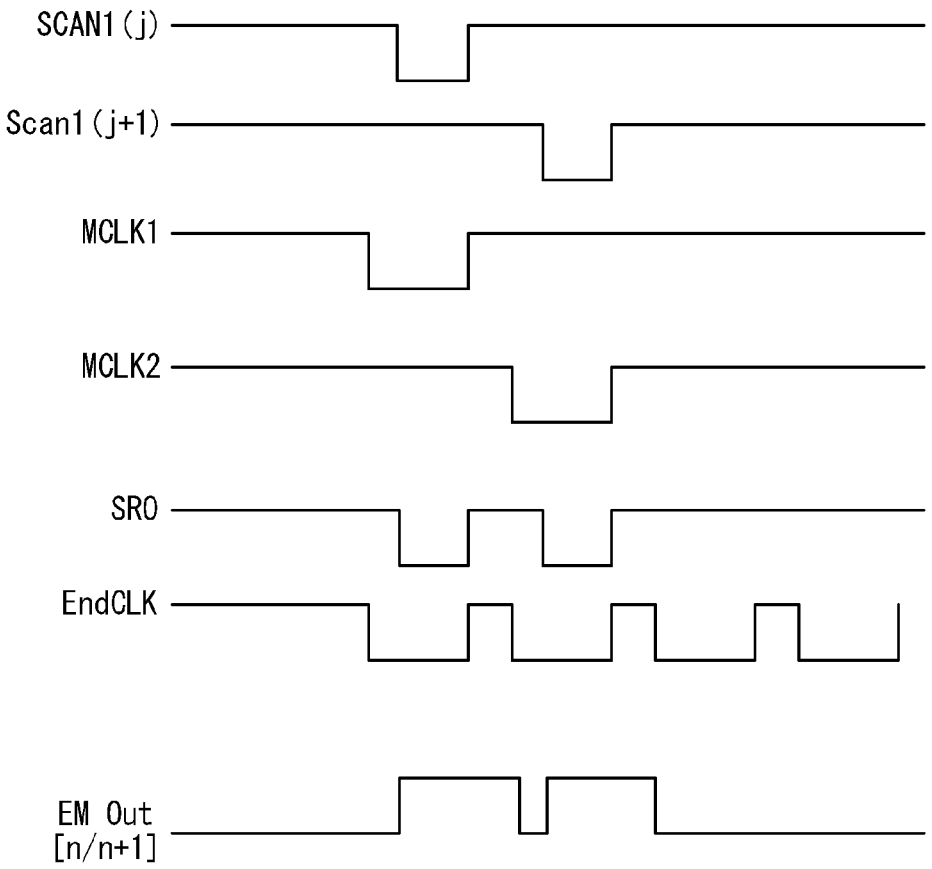
FIG. 5 illustrates an input and an output of a multiplexer shown in FIG. 4.

FIG. 4 illustrates a multiplexer of an emission control signal stage, and FIG. 5 illustrates an input and an output of an emission control signal stage.

Referring to FIGS. 4 and 5, a multiplexer MUX(j) includes a first multiplexer switch Tm1 and a second multiplexer switch Tm2. A first electrode of the first multiplexer switch Tm1 receives the jth first scan signal SCAN1(j), a second electrode of the first multiplexer switch Tm1 is connected to a multiplexer output terminal Nm, and a gate electrode of the first multiplexer switch Tm1 receives a first multiplexer clock MCLK1. A first electrode of the second multiplexer switch Tm2 receives the (j+1)th first scan signal SCAN1(j+1), a second electrode of the second multiplexer switch Tm2 is connected to the multiplexer output terminal Nm, and a gate electrode of the second multiplexer switch Tm2 receives a second multiplexer clock MCLK2. The multiplexer MUX(j) outputs an emission reset signal SRO during a period in which the first multiplexer clock MCLK1 and the jth first scan signal SCAN1(j) are synchronized, and a period in which the second multiplexer clock MCLK2 and the (j+1)th first scan signal SCAN1(j+1) are synchronized. A width of the first multiplexer clock MCLK1 is set to be greater than a width of the jth first scan signal SCAN1(j), and a width of the second multiplexer clock MCLK2 is set to be greater than a width of the (j+1)th first scan signal SCAN1(j+1).

The emission control signal stage EMD(j) receives the emission reset signal SRO and an end clock EndCLK and outputs an emission control signal EM(j). The emission reset signal SRO determines a timing of a turn-off voltage level of the emission control signal EM(j). The end clock EndCLK determines an output timing of a turn-on voltage level of the emission control signal EM(j). The emission control signal stage EMD(j) outputs the emission control signal EM(j) at a turn-off level when the emission reset signal SRO changes from a high level to a low level. Further, the emission control signal stage EMD(j) outputs the emission control signal EM(j) at a turn-on level when the end clock EndCLK is output (i.e., when the end clock EndCLK changes from a high level to a low level).

Figure 6:
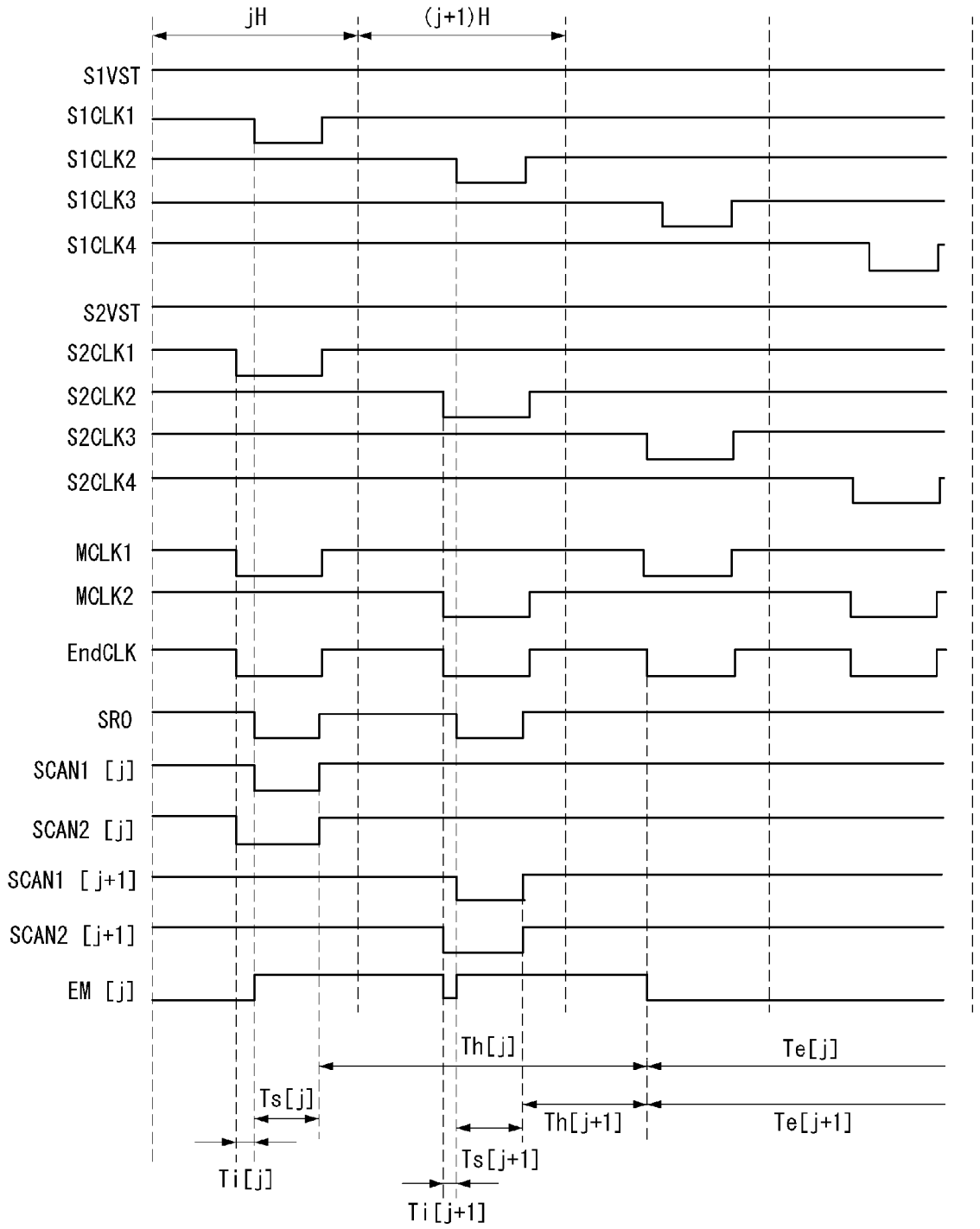
FIG. 6 illustrates an input and an output of a shift register shown in FIG. 3.

FIG. 6 is a timing diagram illustrating an input signal and an output signal of each stage.

With reference to FIGS. 3 to 6, a process where the shift register 140 outputs the first scan signals SCAN1(j) and SCAN1(j+1), the second scan signals SCAN2(j) and SCAN2(j+1), and the emission control signal EM(j) is described below. In FIG. 6, a jth horizontal period jH includes an initialization period and a sampling period of the jth pixels Pj arranged on the jth horizontal line.

The first scan signal stage receives one of first scan clocks S1CLK1 to S1CLK4 and outputs a first scan signal having the same timing as the received first scan clock. A cycle of each of the first scan clocks S1CLK1 to S1CLK4 may be one horizontal period H. FIG. 6 illustrates four-phase first scan clocks S1CLK1 to S1CLK4 by way of example. However, phases of the first scan clocks S1CLK1 to S1CLK4 may vary depending on a width of an overlap drive or a driving method.

More specifically, the first scan signal stage SCAN1D(j) of the jth horizontal line receives the first scan clock S1CLK1, that is firstly input among the first scan clocks 51CLK1 to S1CLK4, and outputs the jth first scan signal SCAN1(j) corresponding to a timing of the first scan clock S1CLK1.

Further, the first scan signal stage SCAN1D(j+1) of the (j+1)th horizontal line receives the first scan clock S1CLK2, that is secondly input among the first scan clocks S1CLK1 to S1CLK4, and outputs the (j+1)th first scan signal SCAN1(j+1) corresponding to a timing of the first scan clock S1CLK2.

The second scan signal stage receives one of second scan clocks S2CLK1 to S2CLK4 and outputs a second scan signal having the same timing as the received second scan clock. A cycle of each of the second scan clocks S2CLK1 to S2CLK4 may be one horizontal period H. FIG. 6 illustrates four-phase second scan clocks S2CLK1 to S2CLK4 by way of example. However, phases of the second scan clocks S2CLK1 to S2CLK4 may vary depending on a width of an overlap drive or a driving method.

More specifically, the second scan signal stage SCAN2D (j) of the jth horizontal line receives the second scan clock S2CLK1, that is firstly input among the second scan clocks S2CLK1 to S2CLK4, and outputs the jth second scan signal SCAN2(j) corresponding to a timing of the second scan clock S2CLK1.

Further, the second scan signal stage SCAN2D(j+1) of the (j+1)th horizontal line receives the second scan clock S2CLK2, that is secondly input among the second scan clocks S2CLK1 to S2CLK4, and outputs the (j+1)th second scan signal SCAN2(j+1) corresponding to a timing of the second scan clock S2CLK2.

The multiplexer MUX(j) of the emission control signal stage EMD(j) of the jth horizontal line outputs the jth emission control signal EM(j) as described above with reference to FIGS. 4 and 5.

As described above, the jth first scan signal SCAN1(j) and the (j+1)th first scan signal SCAN1(j+1) are sequentially applied to the jth pixel Pj and the (j+1)th pixel P(j+1) at intervals of one horizontal period H. Further, the jth second scan signal SCAN2(j) and the (j+1)th second scan signal SCAN2(j+1) are sequentially applied to the jth pixel Pj and the (j+1)th pixel P(j+1) at intervals of one horizontal period H. As a result, an initialization operation and a sampling operation of the jth pixel Pj are performed during the jth horizontal period jH, and an initialization operation and a sampling operation of the (j+1)th pixel P(j+1) are performed during a (j+1)th horizontal period (j+1)H.

The jth emission control signal EM(j) is simultaneously applied to the jth pixel Pj and the (j+1)th pixel P(j+1) and is output as a turn-on voltage in a (j+2)th horizontal period (j+2)H. Namely, the jth pixel Pj starts to emit light after a holding period Th(j) more than one horizontal period H passed from a sampling period Ts(j). The (j+1)th pixel P(j+1) starts to emit light after a holding period Th(j+1) passed from a sampling period Ts(j+1).

As described above, the shift register according to the embodiment supplies the emission control signal to pixels arranged on a pair of horizontal lines adjacent to one emission control signal stage. Thus, the embodiment can reduce the number of emission control signal stages to one half compared to a related art. As a result, the size of the bezel area, in which the emission control signal stages are disposed, can decrease.

A method of driving the OLED display according to the example embodiment using the first scan signal SCAN1, the second scan signal SCAN2, and the emission control signal EM shown in FIG. 6 is described below. Hereinafter, in one embodiment, transistors in a pixel structure may be p-type transistors. However, embodiments are not limited thereto. Further, in the p-type transistors, a turn-on voltage of a gate signal indicates a low level voltage, and a turn-off voltage of a gate signal indicates a high level signal.

The following Table 1 indicates a voltage of each node depending on a pixel driving period. An operation of a pixel P is described in conjunction with FIGS. 2 and 6 and Table 1.

TABLE 1

| | First node | Second node | Fourth node |
|---|---|---|---|
| Initialization period | Vref | Vref | Vref |
| Sampling period | VDD + Vth | VDD + Vth | Vdata |
| Emission period | VDD + Vth − (Vdata − Vref) | VDD | Vref |

An operation of each pixel P includes an initialization period Ti, a sampling period Ts, and an emission period Te. In the initialization period Ti, a main node voltage of the pixel P is initialized. In the sampling period Ts, a threshold voltage of the driving transistor DT is sampled, and a fourth node 4*n* connected to the storage capacitor Cst is charged with the data voltage Vdata. In the emission period Te, the organic light emitting diode emits light without being affected by the threshold voltage of the driving transistor DT.

During the initialization period Ti, a turn-on voltage of the emission control signal EM is applied to the pixel P. The first to fourth transistors T1 to T4 are turned on in response to the emission control signal EM or the second scan signal SCAN2. The third node n3 is initialized to a reference voltage Vref via the fourth transistor T4. The second node n2 is initialized to the reference voltage Vref via the second and fourth transistors T2 and T4. The first node n1 is initialized to the reference voltage Vref via the second node n2 and the first transistor T1. The fourth node n4 is initialized to the reference voltage Vref via the third transistor T3. As a result, all of the first to fourth nodes n1 to n4 are initialized to the reference voltage Vref.

During the sampling period Ts, the first scan signal SCAN1 and the second scan signal SCAN2 are inverted to a turn-on voltage, and the emission control signal EM is inverted to a turn-off voltage. As the emission control signal EM is inverted to the turn-off voltage, the first to third transistors T1 to T3 are turned off. The fourth transistor T4 maintains a turn-on state in response to the second scan signal SCAN2. The fifth transistor TS is turned on in response to the first scan signal SCAN1.

During the sampling period Ts, the fifth transistor T5 charges the fourth node n4 with the data voltage Vdata received from the data line DL. As a result, the fourth node n4 has a voltage adding the data voltage Vdata to the high potential voltage VDD.

As the voltage of the fourth node n4 increases in a state where the second node n2 is floated, a voltage of the first node n1 increases. As the voltage of the first node n1 increases, the driving transistor DT is turned on, and a current flows via a drain electrode and a source electrode of the driving transistor DT. The current flows in the drain electrode and the source electrode of the driving transistor DT until a gate-to-source voltage Vgs of the driving transistor DT is saturated to a threshold voltage Vth of the driving transistor DT. Namely, during the sampling period Ts, a voltage of a gate electrode of the driving transistor DT is a sum of the high potential voltage VDD and the threshold voltage Vth of the driving transistor DT.

After the sampling period Ts ends, the first scan signal SCAN1 and the second scan signal SCAN2 are inverted to a turn-off voltage and maintain the turn-off voltage until the emission period Te ends. During the emission period Te, the emission control signal EM is inverted to a turn-on voltage.

During the emission period Te, the third transistor T3 is turned on in response to the emission control signal EM and charges the fourth node n4 with the reference voltage Vref. As a result, the fourth node n4, that is charged to the data voltage Vdata during the sampling period Ts, is changed to the reference voltage Vref in the emission period Te. Namely, during the emission period Te, the voltage of the fourth node n4 changes by a voltage amount corresponding to a difference "Vdata−Vref" between the data voltage Vdata and the reference voltage Vref. When the voltage of the fourth node n4 changes, a voltage of the first node n1 changes due to the coupling of the storage capacitor Cst. In other words, the voltage of the first node n1 changes to a voltage "VDD−Vth−(Vdata−Vref)" in a state where the voltage of the first node n1 is set to a voltage "VDD−Vth" in the sampling period Ts.

As a result, a relationship equation with respect to a driving current Ioled flowing in the OLED during the emission period Te is represented by the following Equation 1.

$$Ioled = (k/2)(Vsg - Vth)\text{^}2 = (k/2)(VDD - VDD + Vth + Vdata - Vref - Vth)\text{^}2 = (k/2)(Vdata - Vref)\text{^}2 \quad \text{[Equation 1]}$$

In the above Equation 1, "k" is a proportional constant determined by an electron mobility, a parasitic capacitance, a channel capacity, etc. of the driving transistor DT.

The organic light emitting diode emits light in accordance with the relationship equation of the above-described driving current and can display a desired gray level. According to the above Equation 1, the driving current Ioled of the OLED is represented by $k/2(Vgs-Vth)^2$. However, because the threshold voltage Vth of the driving transistor DT of the OLED is included in the gate-to-source voltage Vgs programmed in a sampling period Ts, the threshold voltage Vth of the driving TFT DT is cancelled from the relationship equation of the driving current Ioled as indicated by the above Equation 1. Namely, an influence of changes in the threshold voltage Vth on the driving current Ioled is removed.

In FIG. 2, the first to third transistors T1 to T3 may have a double gate structure, so as to prevent a distortion of an emission luminance due to a leakage current.

So far, the embodiment described the emission control signal stage outputting the same emission control signal to pixels arranged on two horizontal lines. The emission control signal stage may generate an emission control signal supplied to pixels arranged on three or more horizontal lines.

Figure 7:
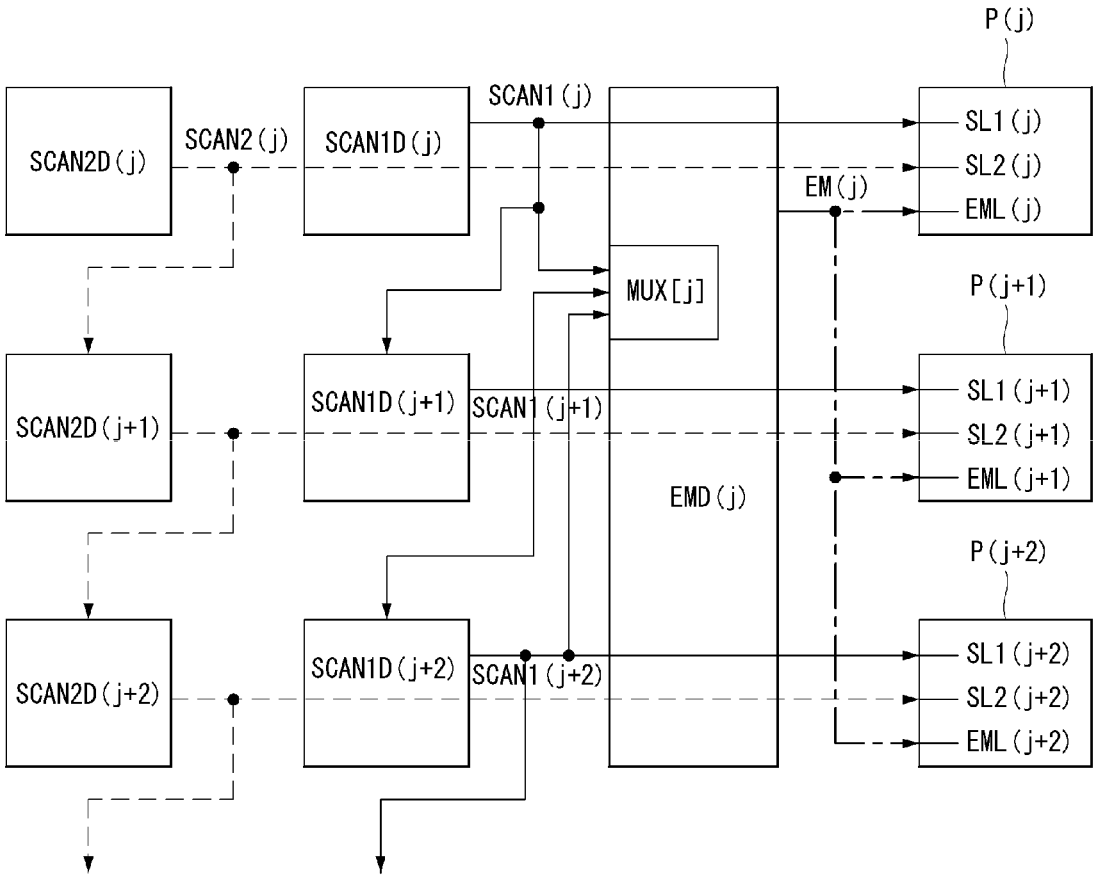
FIG. 7 illustrates a configuration of a shift register according to a second example embodiment.
Figure 8:
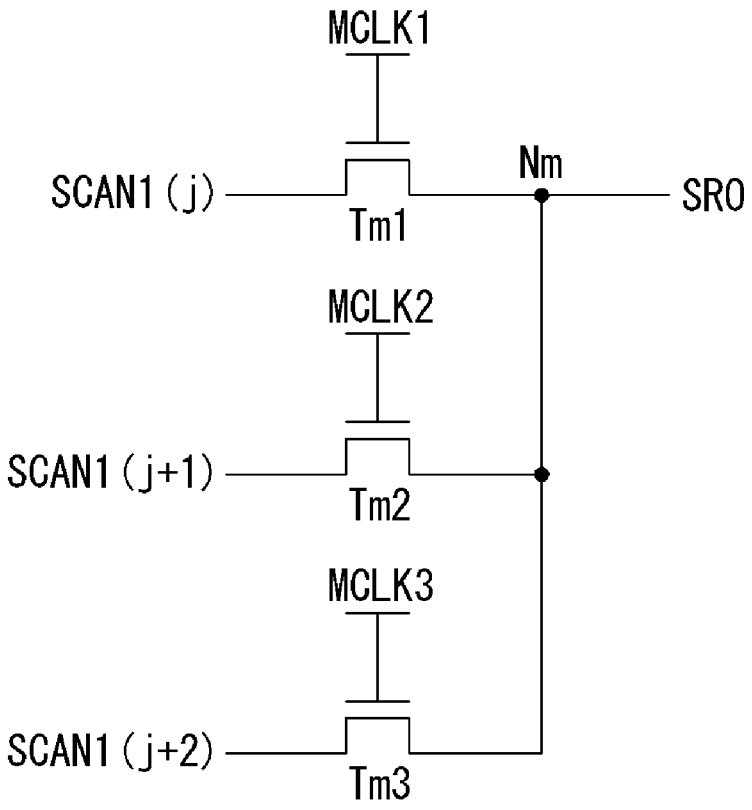
FIG. 8 illustrates a multiplexer of an emission control signal stage shown in FIG. 7.
Figure 9:
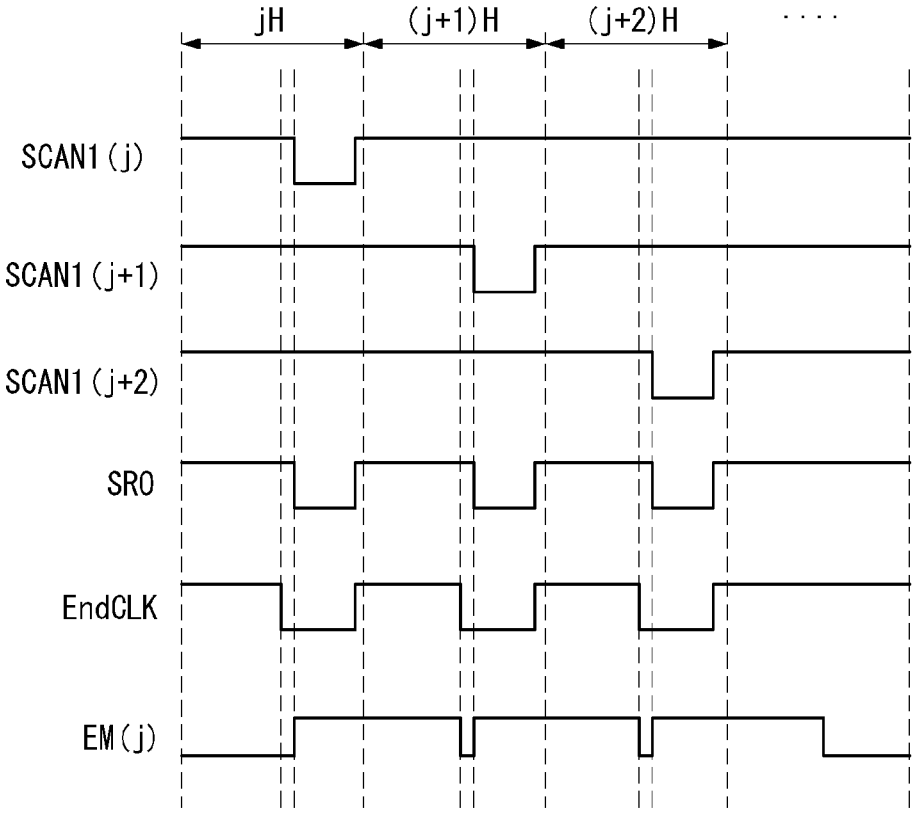
FIG. 9 illustrates an input and an output of a multiplexer shown in FIG. 8.

FIG. 7 illustrates illustrates a configuration of a shift register according to a second example embodiment. FIG. 8 illustrates a timing of an emission control signal output by an emission control signal stage shown in FIG. 7.

Referring to FIGS. 7 and 8, stages for driving pixels P(j), P(j+1), and P(j+2) arranged on three adjacent horizontal lines include a first scan signal stage SCAN1D(j) of a jth horizontal line, a second scan signal stage SCAN2D(j) of the jth horizontal line, a first scan signal stage SCAN1D(j+1) of a (j+1)th horizontal line, a second scan signal stage SCAN2D(j+1) of the (j+1)th horizontal line, a first scan signal stage SCAN1D(j+2) of a (j+2)th horizontal line, a second scan signal stage SCAN2D(j+2) of the (j+2)th horizontal line, and an emission control signal stage EMD(j) of the jth horizontal line.

The first scan signal stages SCAN1D(j), SCAN1D(j+1), and SCAN1D(j+2) sequentially supply a first scan signal SCAN1(j) to the jth to (j+2)th pixels P(j), P(j+1), and P(j+2).

The second scan signal stages SCAN2D(j), SCAN2D(j+1), and SCAN2D(j+2) sequentially supply a second scan signal SCAN2(j) to the jth to (j+2)th pixels P(j), P(j+1), and P(j+2).

Since configuration of the first scan signal stages SCAN1D(j), SCAN1D(j+1), and SCAN1D(j+2) and configuration of the second scan signal stages SCAN2D(j), SCAN2D(j+1), and SCAN2D(j+2) are substantially the same as the embodiment described above, a further description may be briefly made or may be entirely omitted.

The jth emission control signal stage EMD(j) generates a jth emission control signal EM(j) and simultaneously applies the jth emission control signal EM(j) to the jth to (j+2)th pixels P(j), P(j+1), and P(j+2).

The jth emission control signal stage EMD(j) receives the jth first scan signal SCAN1(j), a (j+1)th first scan signal SCAN1(j+1), and a (j+2)th first scan signal SCAN1(j+2) and outputs the jth emission control signal EM(j).

As shown in FIG. 8, a multiplexer MUX(j) of the jth emission control signal stage EMD(j) generates an emission reset signal SRO corresponding to output timing of the jth first scan signal SCAN1(j), the (j+1)th first scan signal SCAN1(j+1), and the (j+2)th first scan signal SCAN1(j+2). Further, the jth emission control signal stage EMD(j) may output the jth emission control signal EM(j) using the emission reset signal SRO and an end clock EndCLK. As the end clock EndCLK, the same signal as that shown in FIG. 6 may be used. Since configuration of the multiplexer MUX(j) is substantially the same as the embodiment described above, a further description may be briefly made or may be entirely omitted.

The emission control signal stage according to the embodiment drives pixels arranged on three adjacent horizontal lines using the same emission control signal, and thus can drive pixels arranged on n horizontal lines using n/3 emission control signal stages.

The first and second embodiments determine output timing of a turn-on voltage level of the emission control signal using the end clock EndCLK.

Figure 10:
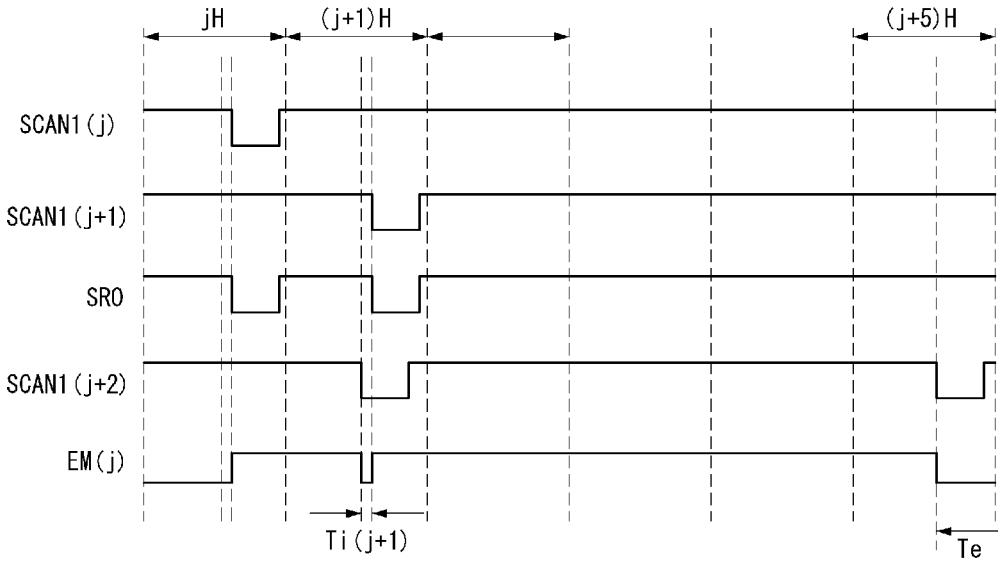
FIG. 10 illustrates an input and an output of an emission control signal stage according to another example embodiment.

FIG. 10 illustrates a control of output timing of a turn-on voltage level of an emission control signal using a second scan signal. As shown in FIG. 10, the emission control signal EM(j) is inverted to a turn-on voltage in response to the emission reset signal SRO at a start time point of an initialization period Ti(j+1) of a (j+1)th horizontal period (j+1)H. Further, the emission control signal EM(j) is turned off at a time point of a turn-on voltage of a (j+1)th second scan signal SCAN2(j+1). Because a cycle of the (j+1)th second scan signal SCAN2(j+1) is four horizontal periods, the (j+1)th second scan signal SCAN2(j+1) is output at a turn-on voltage in a (j+5)th horizontal period (j+5)H after the (j+1)th horizontal period (j+1)H. As a result, the emission control signal EM(j) is inverted to the turn-on voltage in the (j+5)th horizontal period (j+5)H. Namely, the jth and (j+1)th pixels P(j) and P(j+1) start to emit light in the (j+5)th horizontal period (j+5)H.

Figure 11:
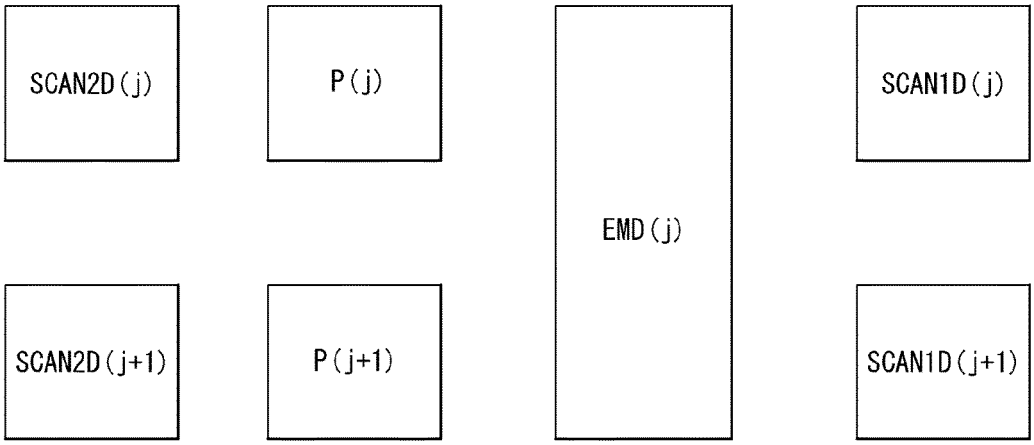
FIGS. 11 and 12 illustrate a modification of a disposition configuration of each stage.

The example embodiments described that the stages of each shift register are disposed on one side of the display area. As shown in FIG. 11, the stages of each shift register may be distributed to both sides of the display area.

Figure 12:
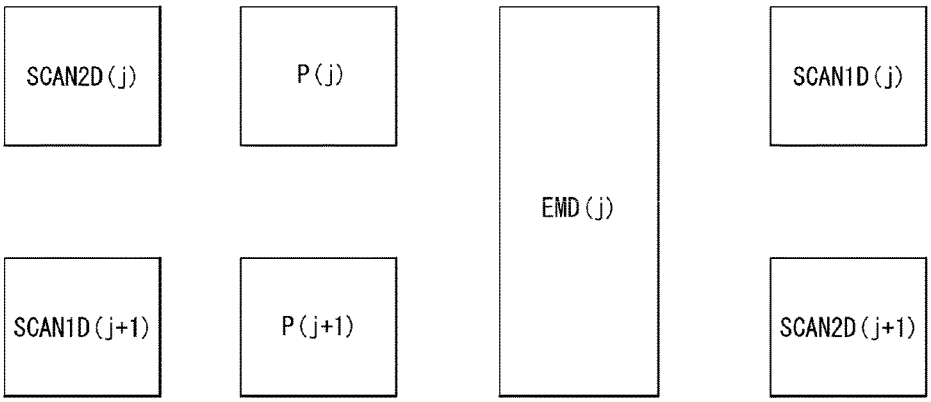

As shown in FIG. 12, the stages may be alternately distributed to both sides of the display area, in which the pixels are disposed. For example, the first scan signal stages SCAN1D may be disposed on the right side of the display area on odd-numbered lines and may be disposed on the left side of the display area on even-numbered lines. Further, the second scan signal stages SCAN2D may be disposed on the left side of the display area on odd-numbered lines and may be disposed on the right side of the display area on even-numbered lines. As described above, the stages disposed on both sides of the display area can reduce or prevent a delay of the first scan signal and the second scan signal attributable to a difference between loads of both sides of the display area.

It will be apparent to those skilled in the art that various modifications and variations can be made in the organic light emitting diode display of the present invention without departing from the spirit or scope of the invention. Thus, it is intended that the present invention cover the modifications and variations of this invention provided they come within the scope of the appended claims and their equivalents.

What is claimed is:

1. An organic light emitting diode display, comprising:

a display area, in which first scan lines, second scan lines, and emission lines are disposed to intersect data lines, and pixels are disposed in a matrix;

a data driver configured to supply a data voltage to the data lines; and a shift register configured to supply a first scan signal to the first scan lines, supply a second scan signal to the second scan lines, and supply an emission control signal to the emission lines, wherein the shift register includes:

a pair of first scan signal stages configured to sequentially supply the first scan signal to pixels arranged on two adjacent horizontal lines;

a pair of second scan signal stages configured to sequentially supply the second scan signal to the pixels arranged on the two adjacent horizontal lines; and an emission control signal stage configured to simultaneously supply the emission control signal to the pixels arranged on the two adjacent horizontal lines, and wherein the first scan signal stages receive a first scan clock and output the first scan signal in synchronization with a timing of the first scan clock, wherein the second scan signal stages receive a second scan clock and output the second scan signal in synchronization with a timing of the second scan clock, wherein the emission control signal stage inverts a voltage level of the emission control signal to a turn-off voltage at a time point, at which the first scan signal is inverted to a turn-on voltage, and wherein the emission control signal stage inverts a voltage level of the emission control signal to a turn-on voltage at a time point, at which the second scan signal is inverted to a turn-on voltage.

2. The organic light emitting diode display of claim 1, wherein pixels arranged on a jth horizontal line are defined as jth pixels, where "j" is a natural number, wherein at least a portion of a holding period of the jth pixels overlaps at least a portion of a sampling period of (j+1 )th pixels, and wherein the emission control signal is simultaneously supplied to the jth pixels and the (j+1)th pixels at a turn-off voltage during a sampling period of the jth pixels and the sampling period of the (j+1)th pixels.

3. The organic light emitting diode display of claim 2, wherein the pixels are supplied with a reference voltage in response to the emission control signal during an initialization period before the sampling period, and wherein the emission control signal having a turn-on voltage level is simultaneously supplied to the jth pixels and the (j+1)th pixels during an initialization period of the (j+1)th pixels.

4. The organic light emitting diode display of claim 1, wherein pixels arranged on a jth horizontal line are defined as jth pixels, where j is a natural number, wherein each jth pixel and each (j+1)th pixel include:

a driving transistor including a gate electrode connected to a first node, a first electrode connected to a second node, and a second electrode connected to an input terminal of a high potential voltage;

a first transistor connected between the first node and the second node, the first transistor including a gate electrode receiving the second scan signal;

a second transistor connected between the second node and a third node corresponding to an anode electrode of an organic light emitting diode, the second transistor including a gate electrode receiving the emission control signal;

a third transistor connected between a fourth node and an input terminal of a reference voltage, the third transistor including a gate electrode receiving the emission control signal;

a fourth transistor connected between the third node and the input terminal of the reference voltage, the fourth transistor including a gate electrode receiving the second scan signal;

a storage capacitor connected between the first node and the fourth node; and a fifth transistor connected between the fourth node and the data line supplied with the data voltage, the fifth transistor including a gate electrode receiving the first scan signal, wherein a jth horizontal period includes an initialization period and a sampling period of the jth pixels, wherein a (j+1)th horizontal period includes an initialization period and a sampling period of the (j+1)th pixels, and wherein an emission period of the jth pixels and an emission period of the (j+1)th pixels simultaneously start at a start time point of a (j+2)th horizontal period.

5. The organic light emitting diode display of claim 4, wherein during the initialization period of the jth horizontal period, the first to fourth transistors of the jth pixel initialize the first to fourth nodes to the reference voltage in response to the emission control signal or the second scan signal.

6. The organic light emitting diode display of claim 5, wherein during the sampling period following the initialization period of the jth horizontal period, the fifth transistor of the jth pixel supplies the data voltage to the fourth node in response to the first scan signal.

7. The organic light emitting diode display of claim 6, wherein the second transistors of the jth pixel and the (j+1)th pixel connect the second node to the organic light emitting diode in response to the emission control signal, that is simultaneously supplied at the start time point of the (j+2)th horizontal period, and cause the organic light emitting diode to emit light.

8. The organic light emitting diode display of claim 4, wherein the first scan signal stages include:

a jth first scan signal stage configured to output a jth first scan signal synchronized with a timing of an ith first scan clock, that is input at a low level during the sampling period of the jth horizontal period, where "i" is a natural number; and a (j+1)th first scan signal stage configured to output a (j+1)th first scan signal synchronized with a timing of an (i+1)th first scan clock, that is input at a low level during the sampling period of the (j+1)th horizontal period, wherein the second scan signal stages include:

a jth second scan signal stage configured to output a jth second scan signal synchronized with a timing of an ith second scan clock, that is input at a low level during the initialization period and the sampling period of the jth horizontal period; and a (j+1)th second scan signal stage configured to output a (j+1)th second scan signal synchronized with a timing of an (i+1)th second scan clock, that is input at a low level during the initialization period and the sampling period of the (j+1)th horizontal period, wherein the emission control signal stage simultaneously supplies the jth pixels and the (j+1)th pixels with the emission control signal, that holds a turn-off voltage during the sampling periods of the jth horizontal period and the (j+1)th horizontal period, holds the turn-off voltage during the initialization period of the (j+1)th horizontal period, and holds the turn-off voltage from the start time point of the (j+2)th horizontal period to an end time point of a frame.

9. The organic light emitting diode display of claim 8, wherein the emission control signal stage receives the ith first scan clock and the (i+1)th first scan clock and includes a multiplexer outputting an emission reset signal during an output period of the ith first scan clock and the (i+1)th first scan clock, and wherein the emission reset signal determines a timing, at which the emission control signal is inverted to a turn-off voltage level.

10. The organic light emitting diode display of claim 9, wherein the multiplexer includes:

a first multiplexer transistor configured to output the ith first scan clock to a multiplexer output terminal in response to a first multiplexer clock; and a second multiplexer transistor configured to output the (i+1)th first scan clock to the multiplexer output terminal in response to a second multiplexer clock, wherein an output of the multiplexer output terminal is used as the emission reset signal.

11. The organic light emitting diode display of claim 10, wherein the emission control signal stage receives an end clock, that is output during the initialization period and the sampling period of each horizontal period, and inverts the emission control signal to a turn-on level at a time point, at which the end clock is input.

12. The organic light emitting diode display of claim 9, wherein the emission control signal stage inverts the emission control signal to a turn-on level at a time point, at which the (j+1)th second scan signal is inverted to a turn-on voltage level.

13. The organic light emitting diode display of claim 1, wherein the first scan signal stages are alternately disposed on left and right sides of the display area, in which the pixels are disposed, and wherein the second scan signal stages are alternately disposed on right and left sides of the display area, on which the first scan signal stages are not disposed.

14. An organic light emitting diode display, comprising:

a display area, in which first scan lines, second scan lines, and emission lines are disposed to intersect data lines, and pixels are disposed in a matrix;

a data driver configured to supply a data voltage to the data lines; and a shift register configured to supply a first scan signal to the first scan lines, supply a second scan signal to the second scan lines, and supply an emission control signal to the emission lines, wherein the shift register includes:

a pair of first scan signal stages configured to sequentially supply the first scan signal to pixels arranged on two adjacent horizontal lines;

a pair of second scan signal stages configured to sequentially supply the second scan signal to the pixels arranged on the two adjacent horizontal lines; and an emission control signal stage configured to simultaneously supply the emission control signal to the pixels arranged on the two adjacent horizontal lines, wherein pixels arranged on a jth horizontal line are defined as jth pixels, where j is a natural number, wherein each jth pixel and each (j+1)th pixel include:

a driving transistor including a gate electrode connected to a first node, a first electrode connected to a second node, and a second electrode connected to an input terminal of a high potential voltage;

a first transistor connected between the first node and the second node, the first transistor including a gate electrode receiving the second scan signal;

a second transistor connected between the second node and a third node corresponding to an anode electrode of an organic light emitting diode, the second transistor including a gate electrode receiving the emission control signal;

a third transistor connected between a fourth node and an input terminal of a reference voltage, the third transistor including a gate electrode receiving the emission control signal;

a fourth transistor connected between the third node and the input terminal of the reference voltage, the fourth transistor including a gate electrode receiving the second scan signal;

a storage capacitor connected between the first node and the fourth node; and a fifth transistor connected between the fourth node and the data line supplied with the data voltage, the fifth transistor including a gate electrode receiving the first scan signal.

* * * * *